US005924368A

United States Patent [19]

Kato

[11] Patent Number: 5,924,368

[45] Date of Patent: Jul. 20, 1999

[54] WASTE TREATMENT FURNACE

[75] Inventor: Masatoshi Kato, Nakatsugawa, Japan

[73] Assignee: Fusoh Co., Ltd., Gifu-Ken, Japan

[21] Appl. No.: 08/880,523

[22] Filed: Jun. 23, 1997

[30] Foreign Application Priority Data

Aug. 5, 1996 [JP] Japan ..... 8-206008

[51] Int. Cl.[6] ..... F23G 5/00

[52] U.S. Cl. ..... 110/255; 110/208; 110/211; 110/215; 110/235; 110/253; 110/165 R; 110/295; 110/302; 110/318; 110/319

[58] Field of Search ..... 110/203, 208, 110/210, 211, 212, 215, 233, 235, 238, 246, 253, 255, 295, 302, 317, 318, 319, 320, 346, 165 R, 185, 344, 345, 322; 431/5

[56] References Cited

U.S. PATENT DOCUMENTS

| | | | |
|---|---|---|---|
| 2,960,943 | 11/1960 | Andersen | 110/185 |
| 3,223,058 | 12/1965 | Tanner . | |
| 3,417,716 | 12/1968 | Iacobovici | 110/346 X |
| 3,537,410 | 11/1970 | Zanft | 110/344 |
| 4,019,445 | 4/1977 | Stoia et al. | 110/165 R X |

FOREIGN PATENT DOCUMENTS

| | | |
|---|---|---|
| 640336 | 12/1983 | China . |
| 0623797 | 11/1994 | European Pat. Off. . |

OTHER PUBLICATIONS

Patent Abstracts of Japan, vol. 008, No. 026 (M–273), Feb. 3, 1984 & JP 58 184420 A (Hitachi Zosen KK), Oct. 27, 1983.

*Primary Examiner*—James C. Yeung
*Assistant Examiner*—Ljiljana V. Ciric
*Attorney, Agent, or Firm*—Dennison, Meserole, Scheiner & Schultz

[57] ABSTRACT

A waste treatment furnace includes a first waste treatment chamber with a first burner chamber communicating therewith, and a second waste treatment chamber with a second burner chamber communicating therewith. A common bottom wall is positioned under the first and second waste treatment chambers which is inclined downwardly from the first chamber to the second chamber to facilitate transfer of waste. Each burner chamber includes a burner and a plurality of protuberances disposed across its inner surface. The protuberances effectively reflect heat from the first and second burners so that the heater air in the first and second burner chambers is homogenized.

7 Claims, 4 Drawing Sheets

WASTE TREATMENT FURNACE

BACKGROUND OF THE INVENTION

1. Field of the Invention

The present invention relates to a waste treatment furnace for treating various types of waste.

2. Description of the Prior Art

A conventional waste treatment furnace is constituted generally of a furnace body having a substantially closed treatment cavity into which waste to be treated or burned is received, and a burner mounted on one end of the furnace body for burning up the waste. As will be easily understood, the waste as burned is recovered as burnt residues or ashes.

It has been discovered by the inventor of the present invention that the waste as burned (ashes produced from burning of the waste) is melted when it is heated to high temperatures greater than about 1350° C. The molten residue can be solidified by cooling and recovered as solid residue. As will be apparent, the solid material thus formed can be more effectively and easily reused than the ashes. Additionally, it has been discovered that dioxin produced during burning operation of the waste may be decomposed when the burning operation is conducted at such high temperatures.

However, in the conventional waste treatment furnace, flame of the burner is locally directed to the waste to be treated, which causes a local rise in temperature of the waste. In other words, the treatment cavity is locally heated. Thus, the waste is never uniformly heated to the high temperatures greater than about 1350° C. As a result, the waste as burned is recovered only as the ashes since it cannot be melted to the molten residue.

SUMMARY OF THE INVENTION

It is an object of the invention to provide a waste treatment furnace which may heat waste to be treated to high temperatures not less than 1350° C.

In order to attain the object, the present invention provide a waste treatment furnace including a waste treatment chamber to receive waste to be treated, a burner chamber communicating with the waste treatment chamber, and a burner provided in the burner chamber. The burner is adapted to heat air in the burner chamber so that the air as heated is introduced into the waste treatment chamber to heat the waste received in the waste treatment chamber.

With the waste treatment furnace, the waste is uniformly heated to extremely high temperatures so as to be effectively burned up and melted to produce molten residue. This is because the air in the burner chamber is heated to high temperatures not less than 1350° C. and the waste is heated by the hot air generated in the burner chamber. It is to be noted that the waste is heated to such high temperatures since it is heated by the hot air and not directly heated by flame of the burner.

Furthermore, with the waste treatment furnace, the molten residue can be recovered as solid residue when cooled. The solid residue may be easily handled and reused. Additionally, dioxin produced by burning up of the waste is decomposed since the waste is exposed to the high temperatures. This may contribute to environmental preservation.

The burner may be arranged to be directed to the waste treatment chamber. Further, the burner chamber and the burner may be designed to give relationships:

$\phi < H$ and $W < 2.5\phi$ where $\phi$ is a maximum diameter of flame F of the burner, and H and W are height and width of the burner chamber, respectively, and $D/4 < L < 2D$ where L is length of the flame F of the burner, and D is depth of the burner chamber.

With this construction, the air In the burner chamber is more efficiently heated and the waste is effectively heated.

The burner chamber may have a plurality of protuberances provided on an inner surface thereof.

With this construction, the inner surface of the burner chamber exhibits increased heat reflectability. As a result, the air in the burner chamber is further efficiently and uniformly heated.

The waste treatment funnel may include a cooling tank communicating with the waste treatment chamber.

With this construction, the molten residue is speedily cooled to produce solid residue.

The waste treatment funnel may include a funnel for discharging exhaust gas generated in the waste treatment chamber through the cooling tank.

With this construction, a part of the hot air constantly flows from the waste treatment chamber to the cooling tank, thereby keeping a juncture area of the waste treatment chamber and the cooling tank to the high temperature. Thus, the molten residue smoothly flows into the cooling tank without forming icicle-like deposits at the juncture area, and is reliably cured in the cooling tank to produce the solid residue as required.

The present invention will become more fully apparent from the claims and the description as it proceeds in connection with the drawings.

DETAILED DESCRIPTION OF THE PREFERRED EMBODIMENTS

A preferred embodiment of the present invention will now be described in detail with reference to the drawings.

Figure 1:
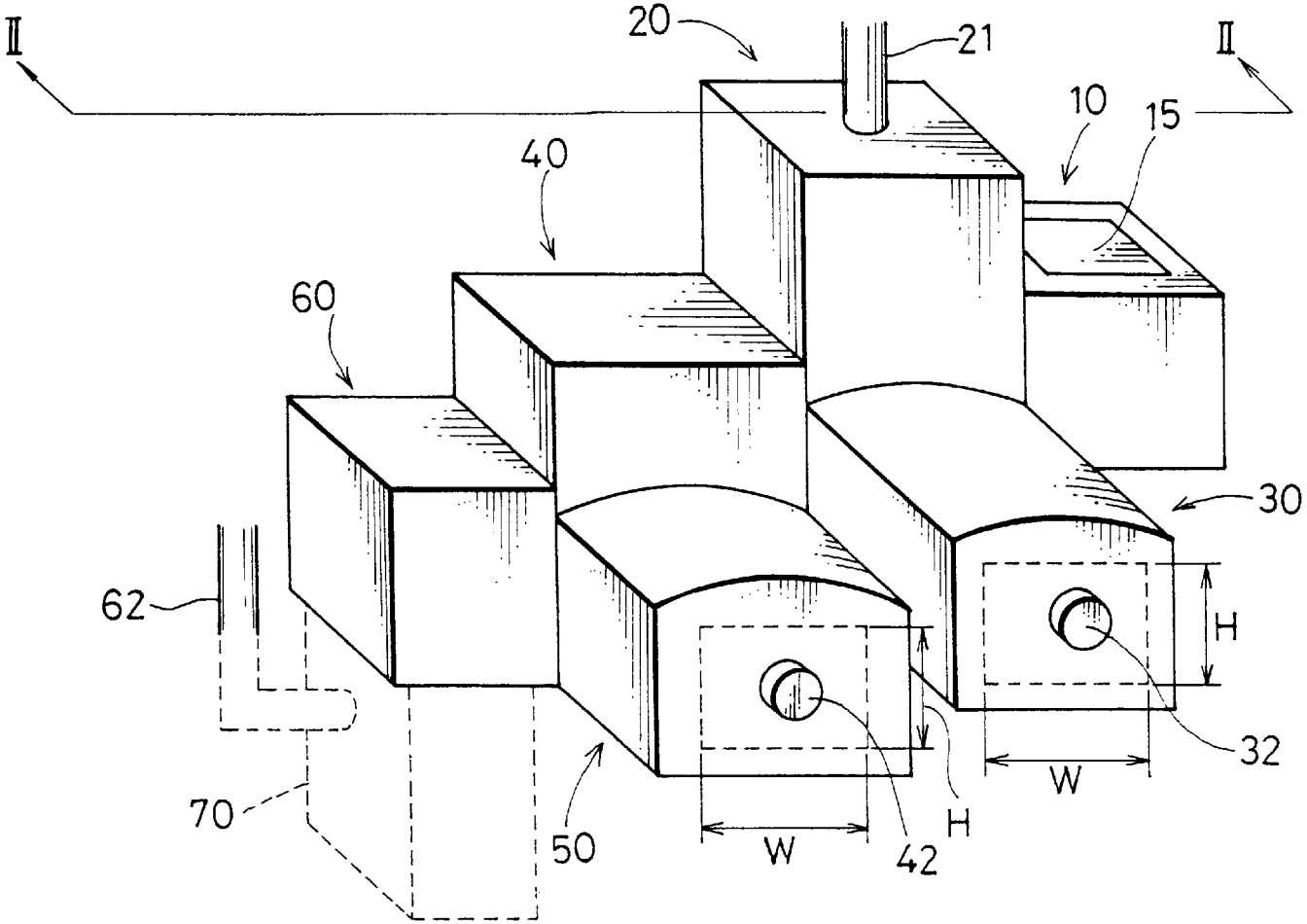
FIG. 1 is a perspective view of a waste treatment furnace according to an embodiment of the present invention.
Figure 2:
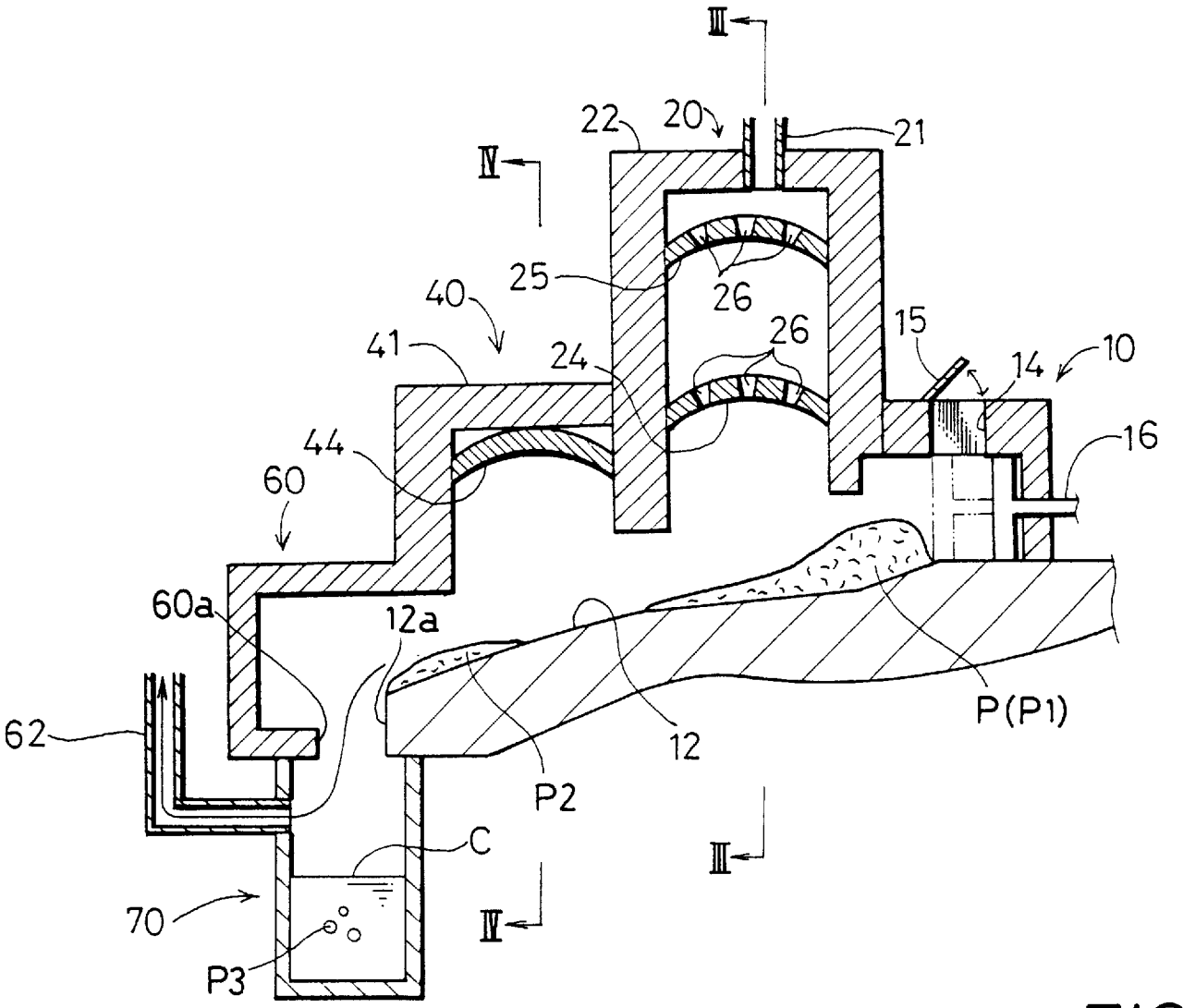
FIG. 2 is a sectional view taken along line II—II of FIG. 1.
Figure 3:
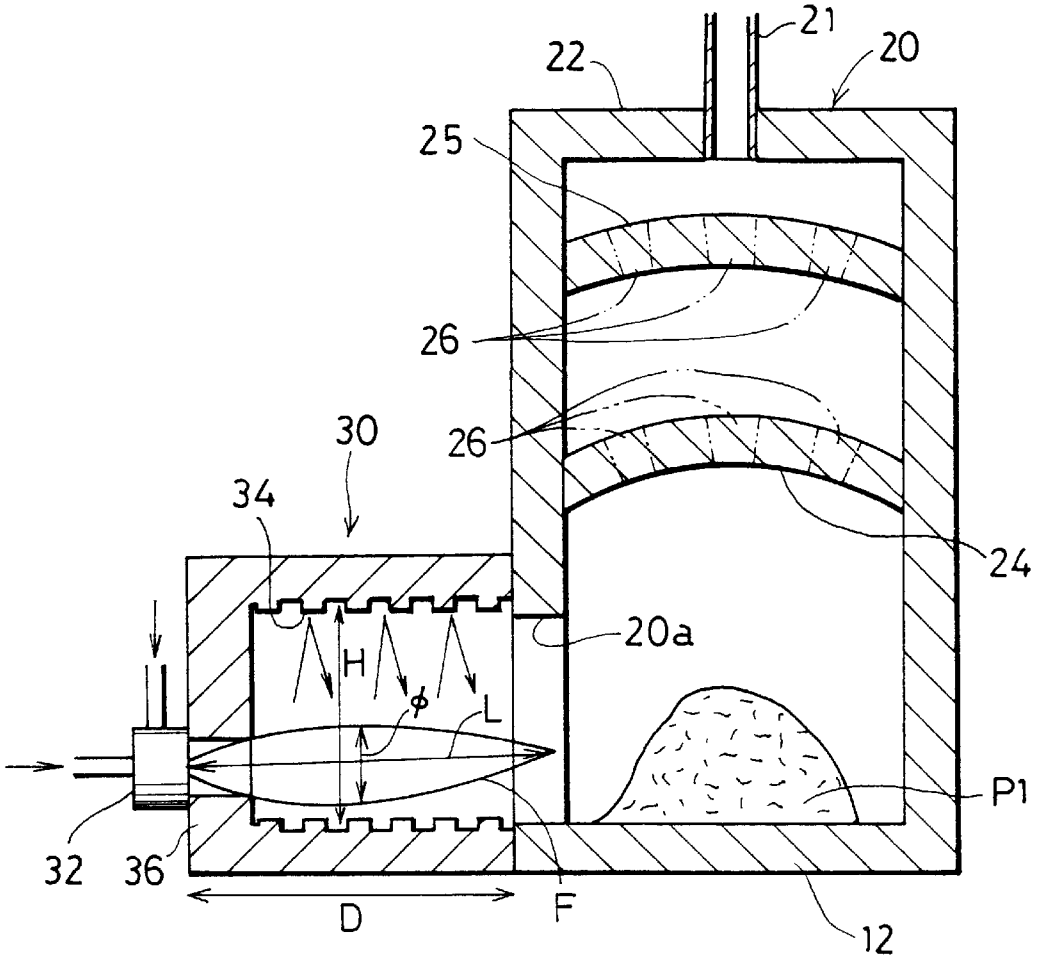
FIG. 3 is an enlarged sectional view taken along line III—III of FIG. 2.
Figure 4:
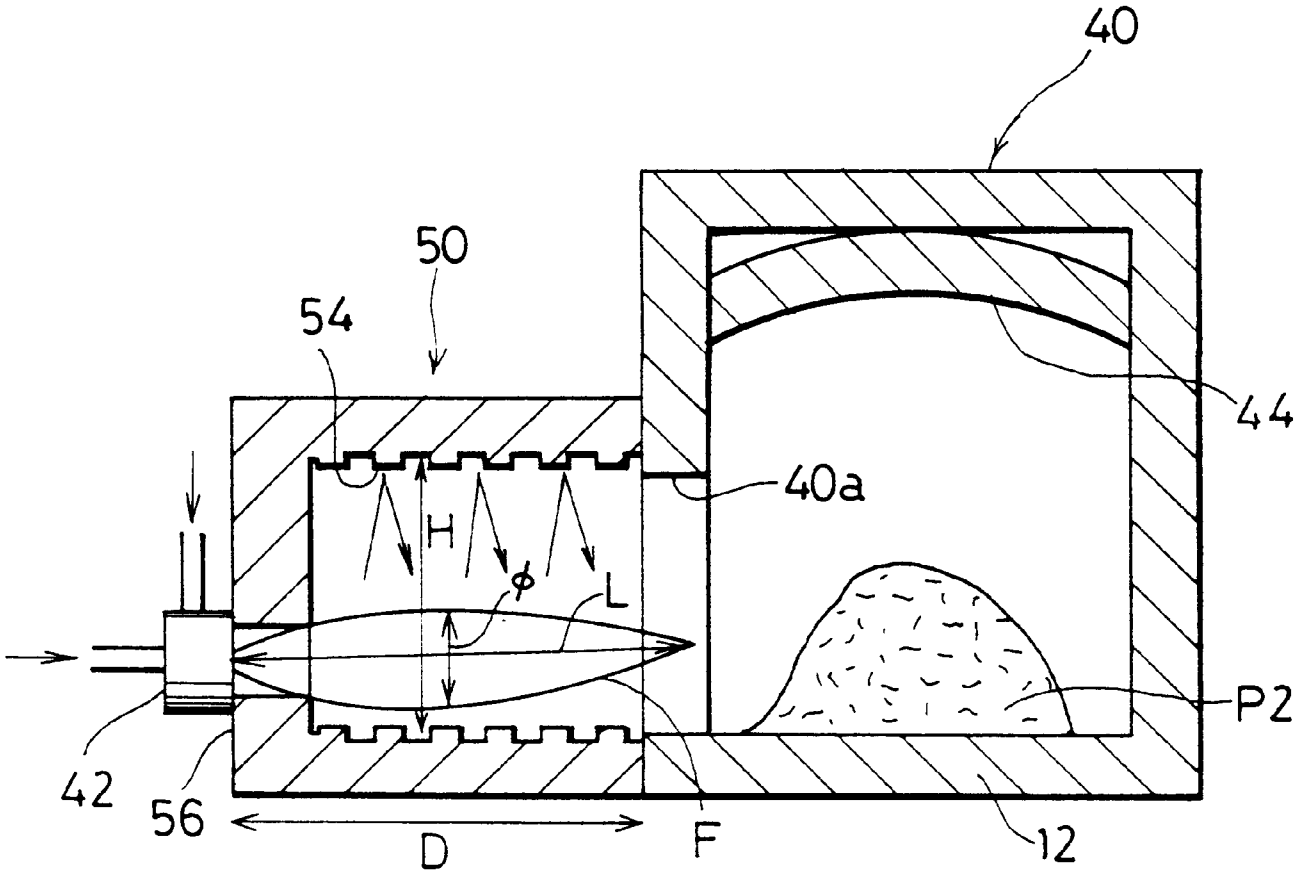
FIG. 4 is an enlarged sectional view taken along line IV—IV of FIG. 2.

As shown in FIGS. 1 and 2, a waste treatment furnace includes a waste input chamber 10, a first waste treatment chamber 20 positioned in the downstream of the waste input chamber 10, and a second waste treatment chamber 40 positioned in the downstream of the first waste treatment chamber 20. As shown in FIG. 2, the waste input chamber 10 and the first and second waste treatment chambers 20 and 40 communicate with each other and have a downwardly inclined common bottom wall 12. As shown in FIG. 3, the first waste treatment chamber 20 is formed with a side opening 20*a* to which a first burner chamber 30 is coupled. Similarly, the second waste treatment chamber 40 is formed with a side, opening 40*a* to which a second burner chamber 50 is coupled (FIG. 4). The waste treatment furnace additionally includes a drop output chamber 60 communicating with the second waste treatment chamber 40 and having an outlet port 60*a* adjacent to a lower end of the common bottom wall 12, and a cooling tank 70 coupled to the outlet port 60*a* of the drop output chamber 60.

The waste input chamber 10 has a waste input opening 14 through which waste P to be treated is introduced into the waste input chamber 10. The waste input chamber 10 is provided with a lid 15 to close the waste input opening 14 after introduction of the waste P thereinto. Further, the waste input chamber 10 is provided with a pusher 16 to impel the waste P introduced therein to the first and second waste treatment chambers 20 and 40.

As shown in FIGS. 2 and 3, the first waste treatment chamber 20 has a hollow bottomless rectangular parallelepipedic configuration and has a stack or funnel 21 provided in an upper wall 22 thereof. The first waste treatment chamber 20 receives an lower baffle wall 24 and an upper baffle wall 25 therein. Each of the lower and upper shield walls 24 and 25 has a domed configuration and is formed with a plurality of vent apertures 26.

As shown in FIG. 3, the first burner chamber 30 includes an end wall 36 through which a first burner 32 is mounted. As will be appreciated, the first burner 32 is preferably arranged to be directed to the waste P. The first burner chamber 30 includes an upper inner surface, an lower inner surface, and side inner surfaces each of which is formed with a plurality of protuberances 34 to increase its heat reflectability.

The first burner chamber 30 and the first burner 32 are designed to give relationships:

$\phi<H$ and $W<2.5\phi$ where $\phi$ is a maximum diameter of flame F of the first burner 32, and H and W are height and width of the first burner chamber 30, respectively, and $D/4<L<2D$ where L is length of the flame F of the first burner 32, and D is depth of the first burner chamber 30.

As shown in FIGS. 2 and 4, the second waste treatment chamber 40 has a hollow bottomless rectangular parallelepipedic configuration. As will be appreciated, the second waste treatment chamber 40 partially utilize an adjacent side wall of the first waste treatment chamber 20. The second waste treatment chamber 40 receives a baffle wall 44 closely adjacent to an upper wall 41. The baffle wall 44 has a domed configuration.

As shown in FIG. 4, the second burner chamber 50 includes an end wall 56 through which a second burner 42 is mounted. As will be appreciated, the second burner 42 is preferably arranged to be directed to the waste P. The second burner chamber 50 includes an upper inner surface, an lower inner surface, and side inner surfaces each of which is formed with a plurality of protuberances 54 to increase its heat reflectability. Like the first burner chamber 30 and the first burner 32, the second burner chamber 50 and the second burner 42 are designed to give the relationships as described above.

The cooling tank 70 is located so that the waste P as burned is introduced thereinto by gravitational force. The cooling tank 70 contains cooling water C therein and is provided with a stack or funnel 62 which is positioned far above the level of the cooling water C.

The operation of the waste treatment funnel thus constructed will now be described with reference to FIGS. 1 to 4.

The lid 15 of the waste input chamber 10 is opened and the waste P (which may be ashes produced from burning of waste in another funnel) is fed into the waste input chamber 10. The waste P is propelled and introduced into the first waste treatment chamber 20 by the pusher 16.

On the other hand, in the first burner chamber 30, the first burner 32 is previously ignited so that air in the first burner chamber 30 is heated to a high temperature, for example, about 1500° C. It is to be noted that the air is excellently uniformly heated to the high temperature. This is because the first burner chamber 30 may exhibit higher and effective heat reflectability due to the presence of the protuberances 34 formed on its inner surfaces.

The hot air thus heated flows into the first waste treatment chamber 20 through the side opening 20*a*. The hot air uniformly heats up the waste P introduced into the first waste treatment chamber 20 to an extremely high temperature. Thus, the waste P is burned up and then melted to produce a molten residue P1. As will be easily understood, heating operation by the hot air may uniformly and efficiently heat up the waste P as compared with direct heating operation by the flame F of the first burner 32. The molten residue P1 thus produced flows down along the common bottom wall 12 and is introduced into the second waste treatment chamber 40.

Similarly, in the second burner chamber 50, the second burner 42 is previously ignited so that air in the second burner chamber 50 is heated to the high temperature. The hot air thus heated flows into the second waste treatment chamber 40 through the side opening 40*a*. The hot air further heats up the molten residue P1 introduced into the second waste treatment chamber 40 to a further extremely high temperature. Thus, the molten residue P1 is completely melted to a final molten residue P2.

The final molten residue P2 thus produced further flows down along the common bottom wall 12 and falls down into the cooling water C reserved in the cooling tank 70 through the outlet port 60*a* of the drop output chamber 60. The final molten residue P2 is cooled and cured by the cooling water C in the cooling tank 70, thereby producing solid residue P3 which may be easily handled and reused.

Additionally, when the molten residue P1 and the final molten residue P2 are produced in the first and second waste treatment chambers 20 and 40, a part of the hot air including exhaust gas generated by burning of the waste P flows through these waste treatment chambers 20 and 40 and the drop output chamber 60 and is discharged through the outlet port 60*a* of the drop output chamber 60 and the funnel 62 of the cooling tank 70. Thus, the lower end 12*a* of the common bottom wall 12 is maintained at a sufficiently high temperature. As a result, the final molten residue P2 smoothly falls down into the cooling tank 70, without curing on the lower end 12*a* of the common bottom wall 12. As will be easily understood, unless the lower end 12*a* is maintained at the sufficiently high temperature, the final molten residue P2 will be cured on the lower end 12*a* to form awkward icicle-like deposits which may prevent the final molten residue P2 from smoothly falling down into the cooling tank 70.

As described above, in the waste treatment furnace of the present invention, dioxin produced by burning up of the waste P may be decomposed since the waste P is exposed to the high temperature of about 1500° C.

The waste treatment furnace according to this embodiment includes the first burner chamber 30 corresponding to the first waste treatment chamber 20 and the second burner chamber 50 corresponding to the second waste treatment chamber 40. However, the first burner chamber 30 can be removed, depending on the kind of the waste P. In the case that the first burner chamber 30 is removed, the waste P in the first waste treatment chamber 20 will be heated by the hot air generated in the second burner chamber 50. Moreover, the second treatment chamber 40 and the second burner chamber 50 can be removed if the waste P is expected to be completely burned and melted in the first waste treatment chamber 20 by the hot air generated in the first burner chamber 30.

The preferred embodiment herein described is intended to be illustrative of the invention and not to limit the invention to the precise form herein described. It is chosen and described to explain the principles of the invention and their application and practical use to enable others skilled in the art to practice the invention.

What is claimed is:

1. A waste treatment furnace comprising:

a first waste treatment chamber to receive waste to be treated;

a first burner chamber communicating with said first waste treatment chamber;

a first burner provided in said first burner chamber;

a second waste treatment chamber communicating with said first waste treatment chamber;

a second burner chamber communicating with said second waste treatment chamber;

a second burner provided in said second burner chamber;

a plurality of protuberances disposed across an inner surface of said first burner chamber and said second burner chamber; and a common bottom wall positioned under said first and second waste treatment chambers which is inclined downwardly from said first waste treatment chamber to said second waste treatment chamber to facilitate transfer of waste from said first waste treatment chamber to said second waste treatment chamber;

said first burner being adapted to heat air in said first burner chamber so that the heated air is introduced into said first waste treatment chamber to heat and burn waste received in said first waste treatment chamber, said second burner being adapted to heat air in said second burner chamber so that the heated air is introduced into said second waste treatment chamber to heat and burn waste received in said second waste treatment chamber, said protuberances effectively reflecting heat from said first and second burners so that heated air in said first and second burner chambers is homogenized.

2. The waste treatment furnace defined in claim 1, further comprising a cooling tank communicating with said second waste treatment chamber and disposed such that waste drops from said common bottom wall in said second waste treatment chamber into said cooling chamber.

3. The waste treatment furnace defined in claim 2, further comprising a funnel for discharging a portion of the heated air generated in said first and second waste treatment chambers through said cooling tank.

4. The waste treatment furnace defined in claim 1, wherein said first burner chamber communicates laterally with said first waste treatment chamber, and said second burner chamber communicates laterally with said second waste treatment chamber.

5. The waste treatment furnace defined in claim 4, wherein the first and second burner chambers each includes a lateral wall, an upper wall and a lower wall, and the each burner is disposed on a lateral wall of a respective chamber, and said protuberances are disposed on upper and lower walls of a respective chamber.

6. The waste treatment furnace defined in claim 1, wherein each of said waste treatment chamber includes a domeshaped baffle disposed in an upper portion thereof.

7. The waste treatment furnace defined in claim 6, wherein the baffle disposed in said first waste treatment chamber includes a plurality of vent apertures therethrough, and the baffle is disposed below an opening in the first treatment chamber.

* * * * *